United States Patent [19]

Marquardt et al.

[11] 3,997,745

[45] Dec. 14, 1976

[54] SWITCHES

[75] Inventors: Erich Marquardt; Werner Storz, both of Rietheim, Germany

[73] Assignee: Firma J & J Marquardt, Germany

[22] Filed: Nov. 29, 1974

[21] Appl. No.: 528,398

[30] Foreign Application Priority Data

Dec. 3, 1973 Germany ..... 2360168

[52] U.S. Cl. ..... 200/76; 200/67 DA

[51] Int. Cl.[2] ..... H01H 15/18

[58] Field of Search ..... 200/67 DA, 67 DB, 67 A, 200/76; 74/100 P

[56] References Cited

UNITED STATES PATENTS

| | | | |
|---|---|---|---|
| 2,420,880 | 5/1947 | Hetherington | 200/67 DA |
| 2,518,255 | 8/1950 | Roeser | 200/76 |

FOREIGN PATENTS OR APPLICATIONS

| | | | |
|---|---|---|---|
| 1,604,169 | 2/1969 | Japan | 200/67 DB |
| 374,418 | 6/1930 | United Kingdom | 200/76 |

*Primary Examiner*—David Smith, Jr.
*Attorney, Agent, or Firm*—William Anthony Drucker

[57] ABSTRACT

The switch is provided with a fixed contact and a movable contact attached to a contact arm which is held by means of a spring in at least one of the portions of said contact arm. The spring and the contact arm are made in one piece to form a bracket-shaped catch element which is pivotally mounted in a bearing in the housing. The spring is stressed at least in the dead center position thereof.

5 Claims, 4 Drawing Figures

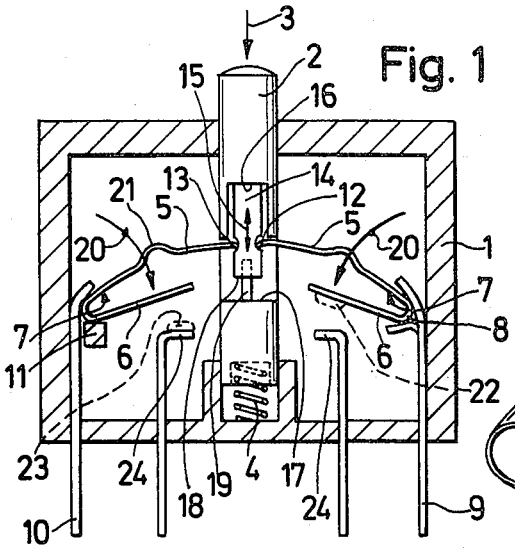
Fig. 1
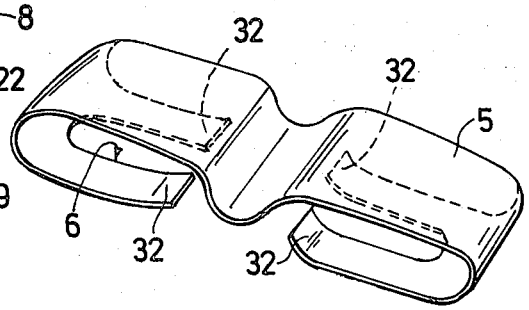
Fig. 4
Fig. 2
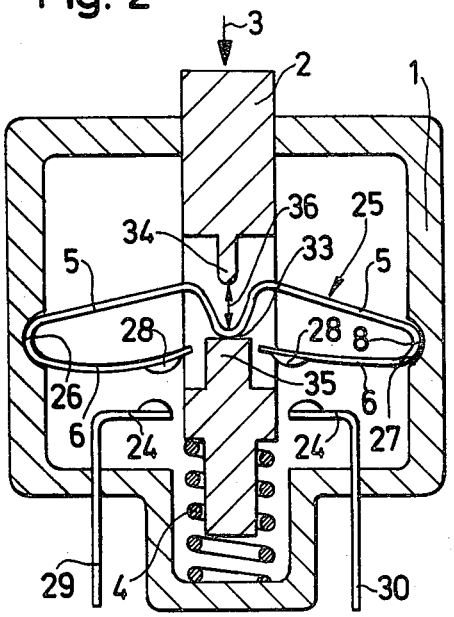
Fig. 3
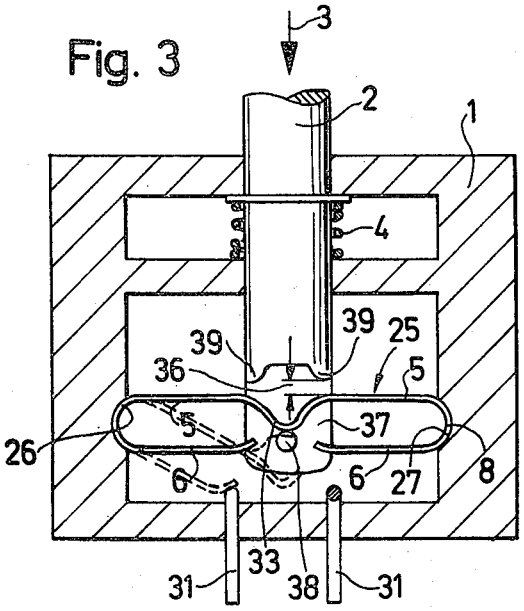

SWITCHES

BACKGROUND OF THE INVENTION

The invention relates to a swtich, particularly a key, with at least one fixed contact and with a movable contact affixed to a contact arm, the said contact arm being held by means of a snap spring in at least one of the two catch positions. Switches of this kind are already known per se. The cost of producing these switches is comparatively high, as the contact arm and the snap spring have to be manufactured and thus mounted separately. The purpose of the present invention is to provide a switch of the kind described at minimum cost.

SUMMARY OF THE INVENTION

According to the present invention we provide in an electric switch comprising:

a. a housing,
b. at least one fixed contact mounted in the housing,
c. a movable contact located for engagement with at least one fixed contact,
d. a contact arm carrying said movable contact being movable between open and closed positions with a snap over action,
e. a snap spring controlling the movement of said contact arm, the spring and contact arm being of a one piece construction which together define a U-shaped catch element pivotally mounted in said housing on the web of the U-shaped catch element, and
f. said spring being stressed at least in a dead centre position between its ends, the improvement being in that two U-shaped elements are provided as a one piece construction defining a single common snap spring which is provided with an arcuate portion in the middle thereof, the apex of the arcuate curved portion facing towards the free ends of the contact arms.

According to another aspect of the invention we provide in an electric switch comprising:

a. a housing,
b. at least one fixed contact mounted in the housing,
c. a movable contact located for engagement with at least one fixed contact,
d. a contact arm carrying said movable contact being movable between open and closed positions with a snap over action,
e. a snap spring controlling the movement of said contact arm, the spring and contact arm being of a one piece construction which together define a U-shaped catch element pivotally mounted in said housing on the web of the U-shaped catch element, and
f. said spring being stressed at least in a dead centre position between its ends, the improvement being in that one end of the spring is pivotably supported on an actuator push rod mounted in the housing of the switch.

The production of the contact arm and the snap spring in one single part results in a saving of time and material and thus in a reduction in cost in the manufacture not only of the parts combined to form a catch element but also in the operation of installing it in the switch. In one preferred embodiment of the invention, two U-shaped catch elements are provided of which the arms face towards each other. They can be switched over together by means of one and the same actuating device. This switch is suitable for opening and closing two different current circuits simultaneously.

In a further embodiment of the invention, that arm of the U-shaped catch element which serves as a plate spring is convex, its middle part having an arcuate portion. This switch is bistable, moving rapidly through a dead centre position from one terminal position to the other. The convexity imparts a certain rigidity to the spring, preventing it from sagging inwards. It would also be possible to design the branch serving as a plate spring with a certain concavity towards the inside.

A futher version of the invention is provided in which the two U-shaped catch elements, on the free ends of the springs, are interconnected, or made in one single piece, having one common catch spring. This is a single-pole switch with two movable and thus inter-acting fixed switch contacts. The two catch elements are then combined to form a contact bridge. The common catch spring has a very advantageous arcuate portion in the middle, the apex of the arcuate portion facing towards the free ends of the contact arms or extending between them. This curve can be utilized for laterally guiding an actuating rod. It also reinforces the combined snap spring.

In a switch with an actuator push rod the latter may have a pressure surface which can be placed against the upper part and one which can be placed against the lower part of the spring, these two pressure surfaces being situated a certain distance apart, in the direction of operation, which exceeds the thickness of the spring. This distance forms a certain free-running section and improves the snap action of this spring.

The free end or free ends of the spring may be pivotably supported on an actuator device, particularly an actuator push rod, mounted in the switch housing. When the rod is pushed down, therefore, the ends of the spring, which are supported thereon, will likewise move, with a simultaneously relative pivoting action. In this switch like-wise, an idle-motion section can be formed for the ends of the spring which are subjected to the actuating force, in which section the spring or springs may be pivotably supported on a supporting element mounted on the actuating rod in such a way that they can be moved longitudinally, in the switching direction, between two stops. It is also of great advantage for at least one of the springs to be supported on a soldering lug or on a metal bearing connected in an electrically conductive manner with a soldering lug. This provides a constant electrical connection between the spring and the soldering lug in question or a similar connecting part of the switch.

A further development of the invention provides that the actuator device of the switch should be displaceable against the force of a restoring spring, so that the movable contact or movable contacts, after the removal of the actuating force, will automatically return to the initial position. This switch is thus monostable.

Particularly low manufacturing costs are obtained if, in a very suitable manner, the free ends of the contact arms are constructed as movable contacts and, in particular, are forked. In special cases contact rivets can be affixed to the free ends of the contact arms in the usual manner. Finally, it is always possible, within the scope of the present invention, to construct the switch having a plurality of switch contacts and, in particular, to provide two catch elements situated side by side or in succession to each other in the direction of operation.

BRIEF DESCRIPTION of DRAWING

The invention will now be described by way of example with reference to the accompanying drawing in which:

FIGS. 1–3 are vertical sections through schematic diagrams of three different versions, and FIG. 4 is a view, in perspective, of the snap spring of the switch shown in FIG. 3.

DESCRIPTION OF PREFERRED EMBODIMENT

With all three switches an actuating device 2 constructed as a push rod, in a housing 1, can be pressed in, against the force of a restoring spring 4, and in the direcrtion shown by the arrow 3. The switch contacts are thus normally in the open position. The snap spring 5 and the contact arm 6 are made in one piece, together forming a U-shaped catch element 7. The bent region, of the U-shaped structure is pivotably mounted in a bearing integral with the housing, the said bearing, according to the right-hand half of the diagram shown in FIG. 1, being possibly formed by the internal subdivided end of a soldering lug 9, or else, as in the left-hand half of the diagram provided in FIG. 1, by the bent end of the soldering lug 10 and an attachment 11 of the housing. The free end 12 of the snap spring 5 is pivotably mounted in a blade bearing 13 of the push rod 2. In a special version of the invention the switch shown in FIG. 1 has two U-shaped catch elements, in addition to which the rod 2 bears, as a special feature, a supporting device 14 movable up and down in the direction shown by the double arrow 15. In this special case it has two blade bearings 13 for the catch springs 5. These latter, when the switch is in the initial position, or in the position of rest, press the supporting device 14 against the upper stop 16 of the rod 2. The lower stop 17 of the rod is situated at a certain distance from the lower end 18 of the supporting device 14, which is displaceable on a pin 19 of the said rod. If the actuating device 2 of the push rod is pressed down in the direction shown by the arrow 3, then the restoring spring 4, constructed as a spiral pressure spring, is stressed, while the two catch elements 7 are at the same time pivoted in the direction shown by the arrows 20. As soon as the two catch springs 5 have reached their dead centre position, they move suddenly downwards, in the manner generally known in the cases of snap switches, in which process the supporting element 14 is displaced in relation to the push rod 2 and comes to rest against the lower stop 17. In the return of the push rod 2 likewise, the supporting element 14 performs an additional upward movement, until it rests against the upper stop 16. This ensures a snap movement independent of the speed of the push rod, in the dead centre position of the springs. In a manner not shown in the drawing, the upper end of the supporting device 14 can be guided additionally, or even exclusively, on the push rod 2.

That arm of the U-shaped structure which forms the snap spring 5, in the version shown in FIG. 1, is slightly convex. In addition, the central zone 21 is arcuate. The contact arm 6, as shown by the broken line in the right-hand catch element 7, can have a contact rivet 22. The fixed contact 24, as shown in the left-hand half of FIG. 1, may likewise be provided with a contact rivet.

In the two variants shown in FIG. 2 and 3 the two catch elements are combined to form a catch unit 25 and are made in one piece. In contradistinction to FIG. 1, therefore, this is a single-pole switch, unless two or more such catch units 25 are arranged side by side or else, as viewed in the direction of operation, in succession to one another. The catch unit 25 is pivotably mounted, on the left and on the right, is shaped bearings 26 and 27 of the housing 1. The two contact arms 6 face towards each other, and each of them may be fitted with a contact rivet 28, as shown in FIG. 2. The same applies to the two fixed cntacts 24. These latter, in the case of FIG. 2 are formed by the bent inner ends of the soldering lugs 29 and 30, as is also the case in the example shown in FIG. 1, while in the construction shown in FIG. 3 use is made of U-shaped structures 31, each of which has at least one of its arms brought out to form a soldering lug. Elongated fixed contacts are required here because the contact arms in this construction are bifurcated, i.e. while all those ends 32 of the contact arms which serve as movable contacts are required to come to rest against the fixed contact 31.

The common spring of the two contact arms 6 is arcuate in its centre, i.e. constructed with a kind of corrugation 33. This corrugation extends into the gap provided between the two movable contacts 28. In FIG. 2 a stem-shaped part 34 of the actuating device 2 engages the corrugation 33 from above. It causes the catch unit 25 to move downwards, the common catch spring being stressed at the same time. When the switch is in the position of rest the lower stem 35 of the push rod rests against the outside of the corrugation and thus against the common snap spring, while the stem-shaped part 34 is at a certain distance from the said common snap spring. In the swiching operation, therefore, the stem-shaped part 34 first moves against the snap spring, not taking the latter with it until a certain release path, corresponding to the distance 36, has been covered. As soon as the dead centre position has been reached, the catch unit 25 moves suddenly downwards, i.e. in the direction shown by the arrow 3, so that the corrugation 33 once again comes to rest on the lower stem 35. Driven by the spring 4, the lower stem 35 again presses the catch unit 25 upwards, as soon as the push rod 2 has been relieved of the actuating force.

The version shown in FIG. 3 does not greatly differ in principle from the switch shown in FIG. 2. The restoring spring 4 is now situated at the top, while those parts of the push rod 2 which comes to rest against the catch unit 25 have been designed on somewhat different lines. The push rod 2 moves with a flat blade 37 past the side of catch unit 25, as is also the case in the push rod or push rod 2 shown in FIG. 2. A transversal pin 38 forms the lower stop, while two lugs 39 situated a certain distance apart combined to form the upper stop for the catch unit 25. The switch-over position is shown by borken lines.

The switch covered by the invention naturally does not necessarily require a soldered connection, and all other known types of connection are possible, such as a plug connection, wire-wrap connection etc., Furthermore, the snap spring 5 and the contact arm 6 may be spread farther apart, when in the relaxed position, than shown in the examples, and may also be convex.

By shaping the device in a special manner and particularly by providing the snap spring 5 with a curvature and lateral stressing, it is possible to ensure automatic restoration of the said snap spring together with the contact arms. In this case the stem 35 serving as a restoring device and also the transversal pin 38 or the line may be dispensed with. The push rod, however, will still preferably be provided with a restoring spring.

We claim:

1. In an electric switch comprising:
a. a housing,
b. at least one fixed contact mounted in the housing,
c. a movable contact located for engagement with at least one fixed contact,
d. a contact arm carrying said movable contact being movable between open and closed positions with a snap over action,
e. a snap spring controlling the movement of said contact arm, the spring and contact arm being of a one piece construction which together define a U-shaped catch element pivotally mounted in said housing on the web of the U-shaped catch element, and
f. said spring being stressed at least in a dead centre position between its ends, the improvement being in that two U-shaped elements are provided as a one piece construction defining a single common snap spring which is provided with an arcuate portion in the middle thereof, the apex of the arcuate curved portion facing towards the free ends of the contact arms.

2. A switch as claimed in claim 1, wherein the apex of the arcuate portion extends between the free ends of the contact arms.

3. In an electric switch comprising:
a. a housing,
b. at least one fixed contact mounted in the housing,
c. a movable contact located for engagement with at least one fixed contact,
d. a contact arm carrying said movable contact being movable between open and closed positions with a snap over action,
e. a snap spring controlling the movement of said contact arm, the spring and contact arm being of a one piece construction which together define a U-shaped catch element pivotally mounted in said housing on the web of the U-shaped catch element, and
f. said spring being stressed at least in a dead centre position between its ends, the improvement being in that one end of the spring is pivotally supported on an actuator push rod mounted in the housing of the switch.

4. A switch as claimed in claim 3, wherein the spring is pivotably supported on a support device mounted on the actuator push rod so that it can be moved longitudinally, as viewed in the switching direction between two stops.

5. A switch as claimed in claim 4, wherein the spring is a plate spring which is convex and provided centrally between its ends with an arcuate portion.

* * * * *